US010714849B2

(12) United States Patent
Mukoyama et al.

(10) Patent No.: US 10,714,849 B2
(45) Date of Patent: Jul. 14, 2020

(54) ELECTRONIC COMPONENT AND SUBSTRATE

(71) Applicant: FUJITSU LIMITED, Kawasaki-shi, Kanagawa (JP)

(72) Inventors: Takahide Mukoyama, Kamakura (JP); Tetsuro Yamada, Kawasaki (JP); Mitsuhiko Sugane, Ichikawa (JP); Yoshiyuki Hiroshima, Nakano (JP); Kohei Choraku, Yokohama (JP); Kazuki Takahashi, Kawasaki (JP); Akiko Matsui, Meguro (JP); Shigeo Iriguchi, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 16/264,881

(22) Filed: Feb. 1, 2019

(65) Prior Publication Data

US 2019/0245284 A1 Aug. 8, 2019

(30) Foreign Application Priority Data

Feb. 8, 2018 (JP) ..... 2018-021338

(51) Int. Cl.

| | |
|---|---|
| ***H01R 12/58*** | (2011.01) |
| ***H01R 12/73*** | (2011.01) |
| ***H01R 12/72*** | (2011.01) |
| ***H01R 12/71*** | (2011.01) |

(52) U.S. Cl.

CPC ..... *H01R 12/585* (2013.01); *H01R 12/716* (2013.01); *H01R 12/724* (2013.01); *H01R 12/737* (2013.01)

(58) Field of Classification Search

CPC .... H01R 12/00; H01R 12/724; H01R 12/737; H01R 12/716; H01R 12/585; H05K 1/11

USPC ..... 439/84

See application file for complete search history.

(56) References Cited

U.S. PATENT DOCUMENTS

| | | | | |
|---|---|---|---|---|
| 4,050,769 | A * | 9/1977 | Ammon | H01R 23/70 439/701 |
| 5,095,359 | A | 3/1992 | Tanaka et al. | |
| 5,215,471 | A * | 6/1993 | Reymond | H01R 12/58 439/341 |
| 5,709,557 | A * | 1/1998 | Martin | H01R 12/722 361/785 |
| 2005/0176268 | A1* | 8/2005 | Zaderej | H01P 1/04 439/55 |

FOREIGN PATENT DOCUMENTS

| | | |
|---|---|---|
| JP | 2-94532 | 4/1990 |
| JP | 2008-146880 | 6/2008 |

* cited by examiner

*Primary Examiner* — Hien D Vu
(74) *Attorney, Agent, or Firm* — Fujitsu Patent Center

(57) ABSTRACT

An electronic component includes: a first terminal that is inserted into a first through hole in a substrate; and a second terminal that is inserted into a second through hole in the substrate, wherein a length of the first terminal from a first end that is inserted into the first through hole to a second end is longer than a length of the second terminal from a third end that is inserted into the second through hole to a fourth end, and a cross sectional area of a portion of the first terminal positioned on a side of the second end with respect to a first joined portion is larger than a cross sectional area of a portion of the second terminal positioned on a side of the fourth end with respect to a second joined portion.

10 Claims, 10 Drawing Sheets

ELECTRONIC COMPONENT AND SUBSTRATE

CROSS-REFERENCE TO RELATED APPLICATION

This application is based upon and claims the benefit of priority of the prior Japanese Patent Application No. 2018-21338, filed on Feb. 8, 2018, the entire contents of which are incorporated herein by reference.

FIELD

The embodiments discussed herein are related to an electronic component and a substrate.

BACKGROUND

Electronic components having terminals inserted into and joined to through holes formed in a substrate are provided.

Related art is disclosed in Japanese Laid-Open Patent Publication No. 2008-146880 and Japanese Laid-Open Patent Publication No. 02-94532.

SUMMARY

According to an aspect of the embodiments, an electronic component includes: a first terminal that is inserted into and joined to a first through hole formed in a substrate; and a second terminal that is inserted into and joined to a second through hole having an inner diameter that is the same as an inner diameter of the first through hole and formed in the substrate, wherein a length of the first terminal from a first end that is inserted into the first through hole to a second end that is opposite to the first end is longer than a length of the second terminal from a third end that is inserted into the second through hole to a fourth end that is opposite to the third end, and a cross sectional area of a portion of the first terminal positioned on a side of the second end with respect to a first joined portion at which the first terminal is joined to the first through hole is larger than a cross sectional area of a portion of the second terminal positioned on a side of the fourth end with respect to a second joined portion at which the second terminal is joined to the second through hole.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

An example of an electronic components having terminals inserted into and joined to through holes formed in a substrate is a right angle type connector. For example, a right angle type connector with improved reliability of connection by making the diameter of a second terminal that is longer than a first terminal larger than that of the first terminal is provided. Further, a semiconductor package including a power supply line pin having a cross sectional area larger than that of a signal line pin is provided.

In an electronic component having a first terminal and a second terminal inserted into and joined to through holes of the substrate, when the lengths of the first terminal and the second terminal are different, a difference may be generated between the electrical resistances of the first terminal and the second terminal. In this case, a difference may be generated between the magnitude of the current flowing through the first terminal and the magnitude of the current flowing through the second terminal.

Hereinafter, embodiments of the present invention will be described with reference to the drawings.

First Embodiment

Figure 1:
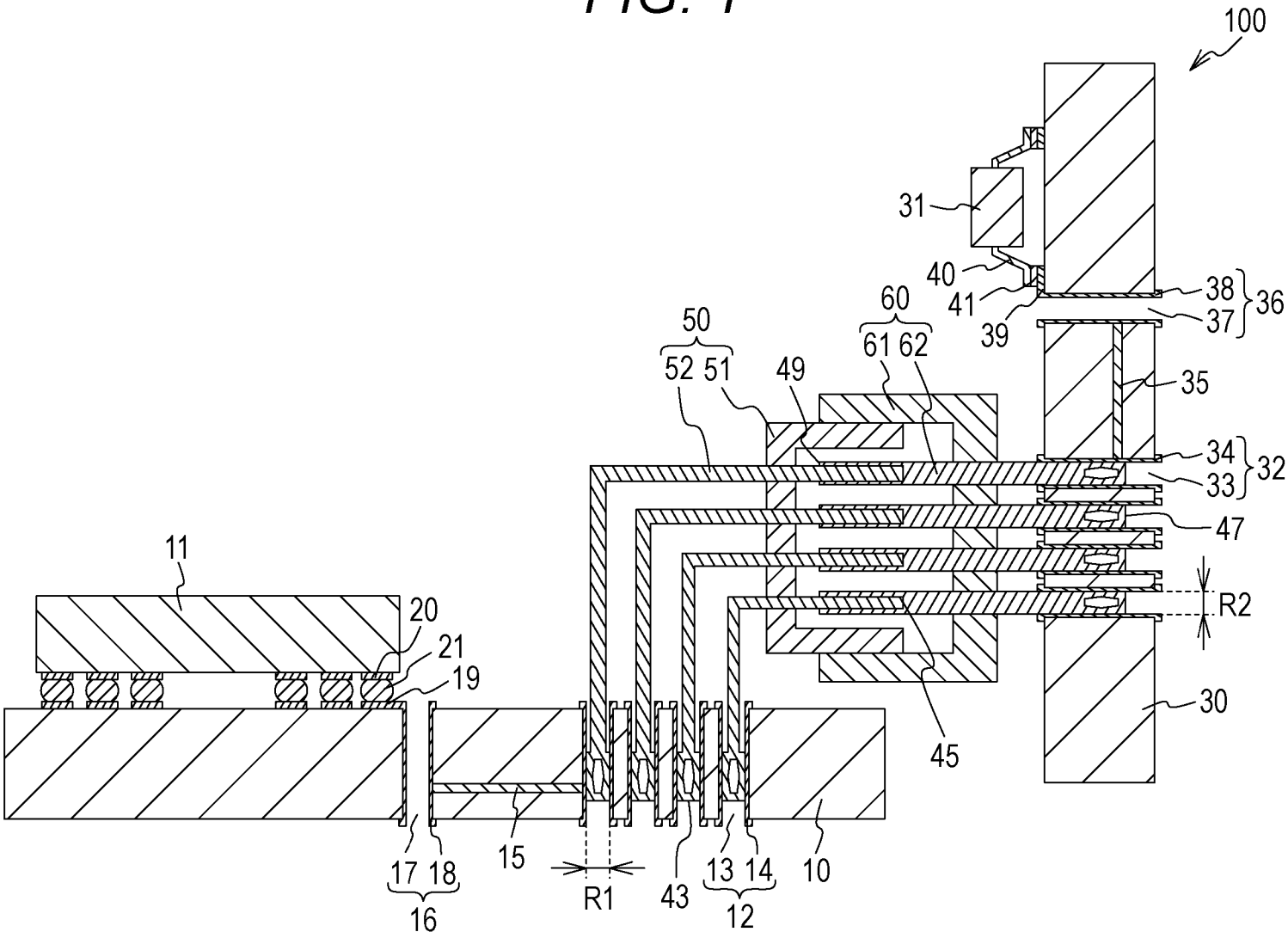
FIG. 1 is a cross-sectional view of an electronic device according to a first embodiment.

As illustrated in FIG. 1, an electronic device 100 includes a substrate 10, a substrate 30, a connector 50, and a connector 60. The substrates 10 and 30 are, for example, printed boards, and are formed from an insulating material such as a thermoplastic resin, a thermosetting resin, or a ceramic. The connector 50 is, for example, a male connector, and the connector 60 is, for example, a female connector. The connector 50 is mounted on the substrate 10, and the connector 60 is mounted on the substrate 30. The connector 50 and the connector 60 are fitted with each other. Thus, the substrate 10 and the substrate 30 are electrically coupled.

A semiconductor component 11 is mounted on the substrate 10. The semiconductor component 11 is a semiconductor chip such as a Large Scale Integration (LSI), for example. An electronic component other than the semiconductor component 11 may be mounted. A plurality of through holes 12 is formed in the substrate 10. All of the inner diameters R1 of the plurality of through holes 12 are of the same length. The phrase, the inner diameters R1 are of the same length, may also mean that the inner diameter R1 which is different by a degree of manufacturing error is included in the inner diameters R2 which are of the same length. Each of the through holes 12 includes a hole 13 passing through the substrate 10 and a metal layer 14 formed on the side wall of the hole 13. The metal layer 14 is formed from, for example, copper. The through holes 12 are coupled to through holes 16 formed in the substrate 10 via internal wirings 15 formed inside the substrate 10. When each of the plurality of internal wirings 15 is connected to corresponding one of the plurality of through holes 12, at least one of the pattern widths and the lengths of the plurality of internal wirings 15 are adjusted such that almost the same magnitude of current flows through the plurality of internal wirings 15. Each of the through holes 16 includes a hole 17 passing through the substrate 10 and a metal layer 18 formed on the side wall of the hole 17. The metal layer 18 is formed from, for example, copper. The through hole 16 is connected to an electrode 19 formed on the upper surface of the substrate 10. The semiconductor component 11 is mounted on the substrate 10 by a solder ball 21 joining an electrode 20 of the semiconductor component 11 to the electrode 19 of the substrate 10. Although the plurality of through holes 16 are formed in the substrate 10, other through holes are not illustrated in FIG. 1 for clarity of the drawing.

The connector 50 has a housing 51 and a plurality of terminals (leads) 52 passing through the housing 51. The housing 51 is formed from an insulating material such as a resin or a plastic, for example. The terminals 52 are formed from a conductive material such as brass or pure copper. The surfaces of the terminals 52 may be plated. One ends 43 of the terminals 52 project from the rear end of the housing 51, and are inserted into and joined to the through holes 12 formed in the substrate 10. The other ends 45 of the terminals 52 project from the front end of the housing 51. The terminals 52 extend in a direction substantially parallel to the upper surface of the substrate 10 from the rear end of the housing 51 and then bend toward the substrate 10 to extend in a direction substantially perpendicular to the upper surface of the substrate 10. As described above, the connector 50 is a right angle type connector.

A power supply unit 31 is mounted on the substrate 30. The power supply unit 31 is, for example, a DC/DC converter, but may be a unit of a different type. A plurality of through holes 32 are formed in the substrate 30. All of the inner diameters R2 of the plurality of through holes 32 are of the same length. The phrase, the inner diameters R2 are of the same length, may also mean that the inner diameter R2 which is different by a degree of manufacturing error is included in the inner diameters R2 which are of the same length. Each of the through holes 32 includes a hole 33 passing through the substrate 30 and a metal layer 34 formed on the side wall of the hole 33. The metal layer 34 is formed from, for example, copper. The through hole 32 is coupled to a through hole 36 formed in the substrate 30 via an internal wiring 35 formed inside the substrate 30. When each of a plurality of internal wirings 35 is coupled to corresponding one of the plurality of through holes 32, at least one of the pattern widths and the lengths of the plurality of internal wirings 35 are adjusted such that almost the same amount of current flows through the plurality of internal wirings 35. The through hole 36 includes a hole 37 passing through the substrate 30 and a metal layer 38 formed on the side wall of the hole 37. The metal layer 38 is formed from, for example, copper. The through hole 36 is coupled to an electrode 39 formed on the upper surface of the substrate 30. The power supply unit 31 is mounted on the substrate 30 by a solder 41 joining a terminal 40 of the power supply unit 31 to the electrode 39 of the substrate 30.

The connector 60 has a housing 61 and a plurality of terminals (leads) 62 passing through the housing 61. The housing 61 is formed from an insulating material such as a resin or a plastic, for example. The terminals 62 are formed from a conductive material such as brass or pure copper. The surfaces of the terminals 62 may be plated. One ends 47 of the terminals 62 project from the rear end of the housing 61, and are inserted into and joined to the through holes 32 formed in the substrate 30. The other ends 49 of the terminals 62 project from the front end of the housing 61. The terminals 62 extend in a direction substantially perpendicular to the upper surface of the substrate 30 from the one ends to the other ends. As described above, the connector 60 is a straight type connector.

The other ends 45 of the terminals 52 of the connector 50 projecting from the front end of the housing 51 are inserted into the other ends 49 of the terminals 62 of the connector 60 projecting from the front end of the housing 61. Thus, the connector 50 and the connector 60 are fitted with each other. Therefore, current flowing from the power supply unit 31 when a power supply voltage is applied flows from the substrate 30 to the substrate 10 via the connectors 50 and 60, and is supplied to the semiconductor component 11. For example, the terminals 52 of the connector 50 and the terminals 62 of the connector 60 are power supply terminals to which current is supplied from the power supply unit 31.

Figure 2A:
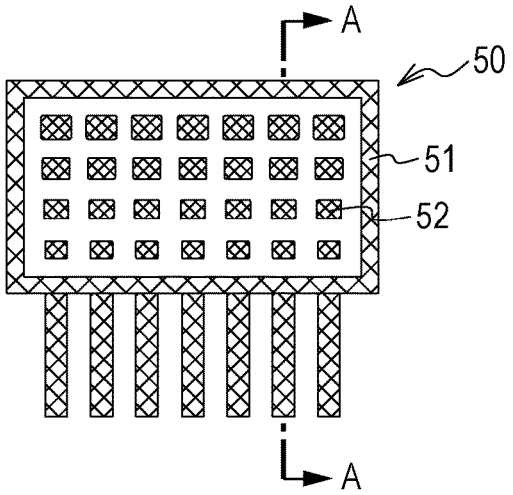
FIG. 2A is a plan view of a connector of the first embodiment as viewed from the front end side.
Figure 2B:
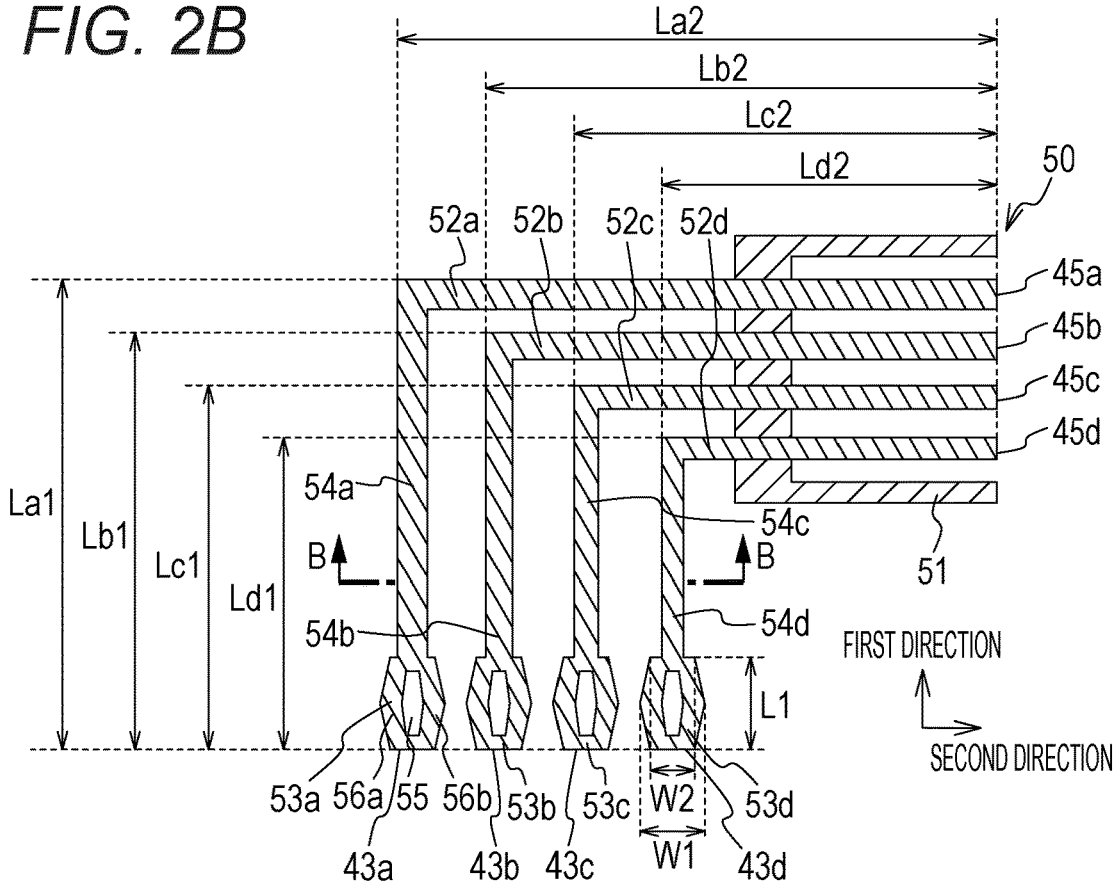
FIG. 2B is a cross-sectional view taken along line A-A of FIG. 2A.
Figure 2C:
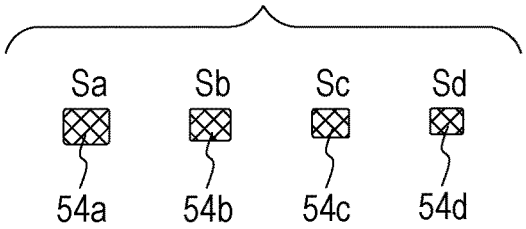
FIG. 2C is a cross-sectional view taken along line B-B of FIG. 2B.

FIG. 2A is a plan view of the connector 50 according to the first embodiment as viewed from the front end side, FIG. 2B is a cross-sectional view taken along line A-A of FIG. 2A, and FIG. 2C is a cross-sectional view taken along line B-B of FIG. 2B. As illustrated in FIG. 2A, in the connector 50, the plurality of terminals 52 passing through the housing 51 is provided in a lattice shape.

Since the connector 50 is a right angle type connector as illustrated in FIG. 2B, terminals 52*a* to 52*d* arranged in the height direction of the housing 51 have lengths that are different from each other. In a case where the terminals 52*a*, 52*b*, 52*c*, and 52*d* are coupled to the housing 51 in this order from the upper side, the lengths of the terminals 52*a*, 52*b*, 52*c*, and 52*d* become shorter in this order.

The terminals 52*a* to 52*d* are, for example, press-fit terminals. The terminals 52*a* to 52*d* have wide press-in portions (press-fit portions) 53*a* to 53*d* formed on one ends 43*a* to 43*d* projecting from the rear end of the housing 51 and extending portions 54*a* to 54*d* that extend toward the other ends 45*a* to 45*d* from the press-in portions 53*a* to 53*d*. The extending portions 54*a* to 54*d* extend in a direction substantially parallel to the upper surface of the substrate 10 from the rear end of the housing 51 and then bend toward the substrate 10 to extend in a direction substantially perpendicular to the upper surface of the substrate 10.

All of the press-in portions 53*a* to 53*d* have the same shape and the same size, and each of the press-in portions 53*a* to 53*d* includes an open hole 55 formed in the center and elastic portions 56*a* and 56*b* formed on both sides with respect to the open hole 55. The phrase, the press-in portions 53*a* to 53*d* have the same shape and the same size, may also mean that the press-in portions 53*a* to 53*d* which have different shapes and sizes by a degree of manufacturing error are included in the press-in portions 53*a* to 53*d* which have the same shape and the same size. Here, the direction in which the extending portions 54*a* to 54*d* extend from the press-in portions 53*a* to 53*d* is referred to as a first direction, and the direction which intersects with (for example, orthogonal to) the first direction is referred to as a second direction. All of the lengths L1 of the press-in portions 53*a* to 53*d* in the first direction are the same. All of the widths W1 of portions of the press-in portions 53*a* to 53*d* located in the center thereof in the first direction are the same. The widths W1 are from the elastic portions 56*a* through the open holes 55 to the elastic portions 56*b* in the second direction. The phrase, the lengths L1 are the same and the widths W1 are the same, may also mean that they are different by a degree of manufacturing error.

All of the widths W2 of portions of the press-in portion 53*a* to 53*d* located at the boundaries between the press-in portions 53*a* to 53*d* and the extending portions 54*a* to 54*d* are the same, and are larger than all of the widths of the extending portions 54*a* to 54*d* at the boundaries. For example, the boundaries between the press-in portions 53*a* to 53*d* and the extending portions 54*a* to 54*d* have a stepped structure. The phrase, the widths W2 are the same, may also mean that the widths W2 which are different by a degree of manufacturing error are included in the widths W2 which are the same.

The extending portions 54*a* to 54*d* have lengths that are different from each other and widths that are different from each other. As described above, the lengths of the terminal 52*a*, the terminal 52*b*, the terminal 52*c*, and the terminal 52*d* become shorter in this order. Here, the length of the terminal 52*a* is defined as (La1+La2), the length of the terminal 52*b* is defined as (Lb1+Lb2), the length of the terminal 52*c* is defined as (Lc1+Lc2), and the length of the terminal 52*d* is defined as (Ld1+Ld2). In this case, a relationship, the length of the terminal 52*a* (La1+La2)>the length of the terminal 52*b* (Lb1+Lb2)>the length of the terminal 52*c* (Lc1+Lc2) >the length of the terminal 52*d* (Ld1+Ld2), is satisfied.

The terminals 52*a* to 52*d* include the press-in portions 53*a* to 53*d* and the extending portions 54*a* to 54*d*. Thus, the length of the extending portion 54*a* is (La1+La2−L1), the length of the extending portion 54*b* is (Lb1+Lb2−L1), the length of the extending portion 54*c* is (Lc1+Lc2−L1), and the length of the extending portion 54*d* is (Ld1+Ld2−L1). Therefore, a relationship, the length of the extending portion 54*a* (La1+La2−L1)>the length of the extending portion 54*b* (Lb1+Lb2−L1)>the length of the extending portion 54*c* (Lc1+Lc2−L1)>the length of the extending portion 54*d* (Ld1+Ld2−L1), is satisfied.

As illustrated in FIG. 2C, the extending portions 54*a* to 54*d* having larger cross sectional areas have larger lengths. For example, the cross sectional areas of the extending portion 54*a*, the extending portion 54*b*, the extending portion 54*c*, and the extending portion 54*d* become smaller in this order. Here, the cross sectional area of the extending portion 54*a* is defined as Sa, the cross sectional area of the extending portion 54*b* is defined as Sb, the cross sectional area of the extending portion 54*c* is defined as Sc, and the cross sectional area of the extending portion 54*d* is defined as Sd. In this case, a relationship, the cross sectional area Sa of the extending portion 54*a*>the cross sectional area Sb of the extending portion 54*b*>the cross sectional area Sc of the extending portion 54*c*>the cross sectional area Sd of the extending portion 54*d*, is satisfied. The cross sectional area of whole of the extending portion 54*a* is substantially constant at Sa. The same applies to the extending portions 54*b* to 54*d*.

Figure 3A:
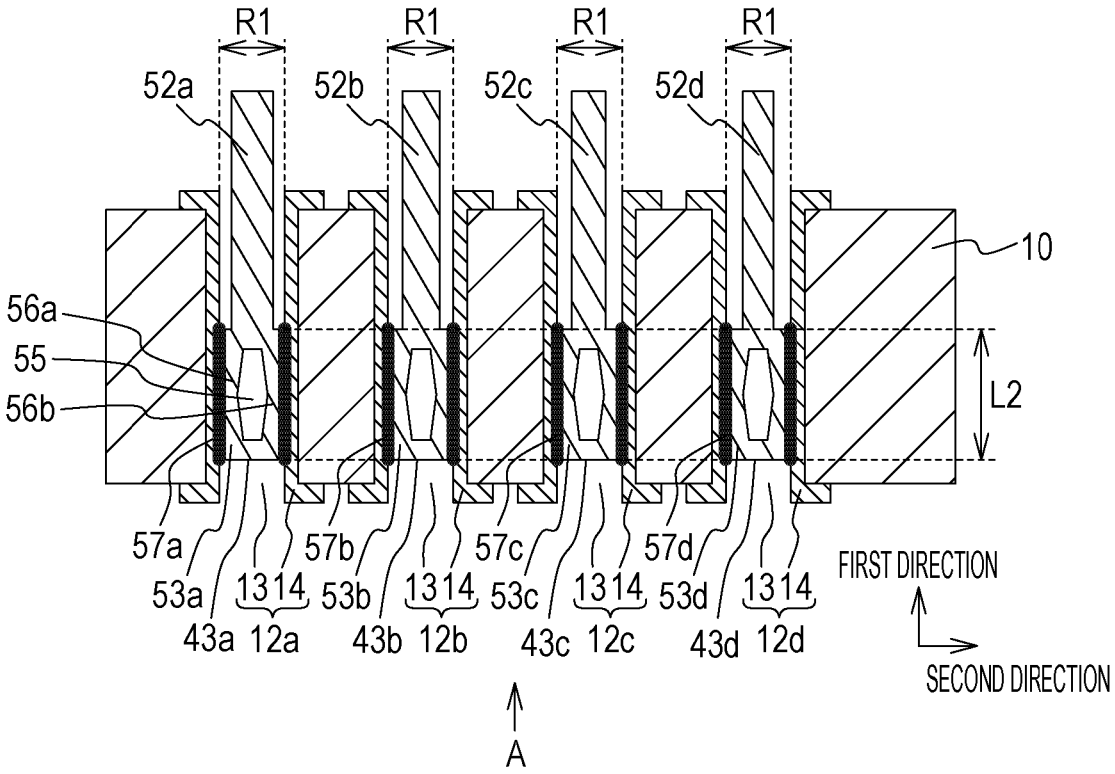
FIG. 3A is an enlarged cross-sectional view of a connecting portion between the connector and a substrate of the first embodiment.
Figure 3B:
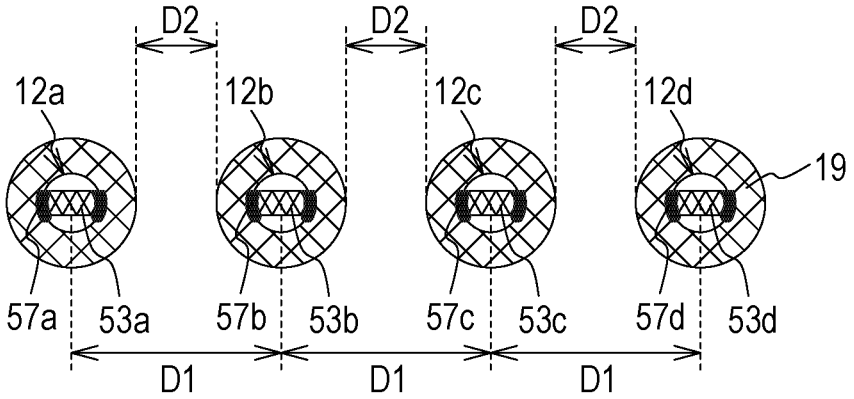
FIG. 3B is a plan view of FIG. 3A as viewed from a direction A.

FIG. 3A is an enlarged cross-sectional view of a connecting portion between the connector 50 and the substrate 10 of the first embodiment, and FIG. 3B is a plan view of FIG. 3A as viewed from a direction A. As illustrated in FIGS. 3A and 3B, the one ends 43*a* to 43*d* of the terminals 52*a* to 52*d* of the connector 50 are inserted into through holes 12*a* to 12*d*. At the one ends 43*a* to 43*d*, the press-in portions 53*a* to 53*d* are provided. The widths of the press-in portions 53*a* to 53*d* are larger than the inner diameter R1 of the through holes 12*a* to 12*d*, and the terminals 52*a* to 52*d* are inserted into the through holes 12*a* to 12*d*, whereby the press-in portions 53*a* to 53*d* are pressed into the through holes 12*a* to 12*d*. Thus, the elastic portions 56*a* and 56*b* included in the press-in portions 53*a* to 53*d* generate elastic restoring force in the second direction and the outer surfaces of the elastic portions 56*a* and 56*b* are brought into pressure contact with the metal layers 14 exposed on the inner surfaces of the through holes 12*a* to 12*d*. Therefore, the terminals 52*a* to 52*d* are electrically coupled to the through holes 12*a* to 12*d*. The portions joined by the terminals 52*a* to 52*d* brought into contact with the through holes 12*a* to 12*d* are referred to as joined portions 57*a* to 57*d*. In FIGS. 3A and 3B, the joined portions 57*a* to 57*d* are represented by bold lines. Since all of the lengths L1 of the press-in portions 53*a* to 53*d* in the first direction are the same (see FIG. 2B), all of the lengths L2 of the joined portions 57*a* to 57*d* in the first direction are the same. The phrase, the lengths L2 are the same, may also mean that the lengths L2 which are different by a degree of manufacturing error are included in the lengths L2 which are the same.

Figure 4A:
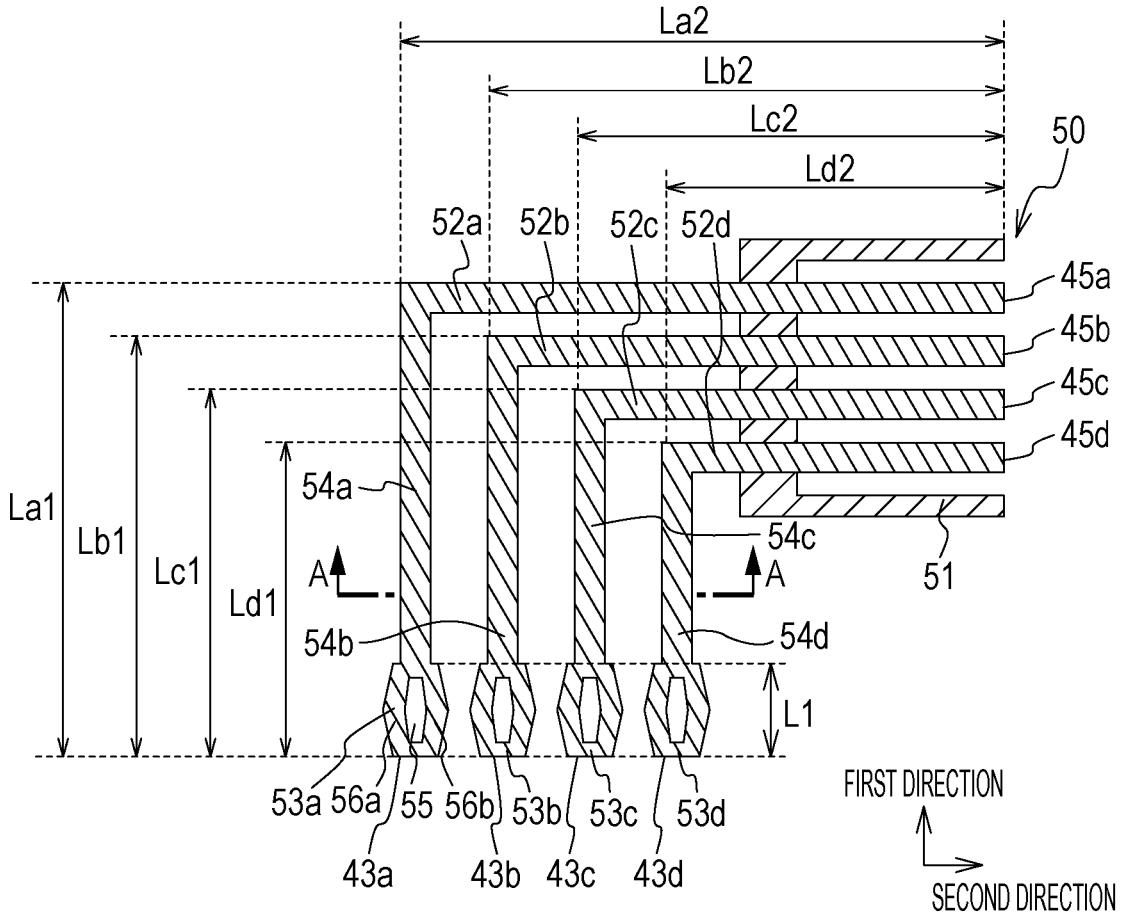
FIG. 4A is a cross-sectional view of a connector of comparative example 1.
Figure 4B:
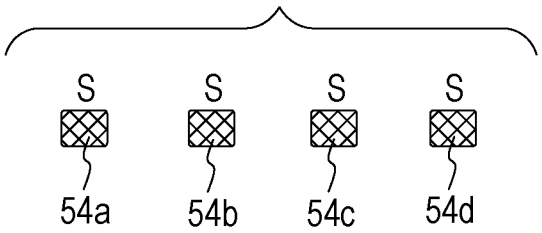
FIG. 4B is a cross-sectional view taken along line A-A of FIG. 4A.
Figure 5A:
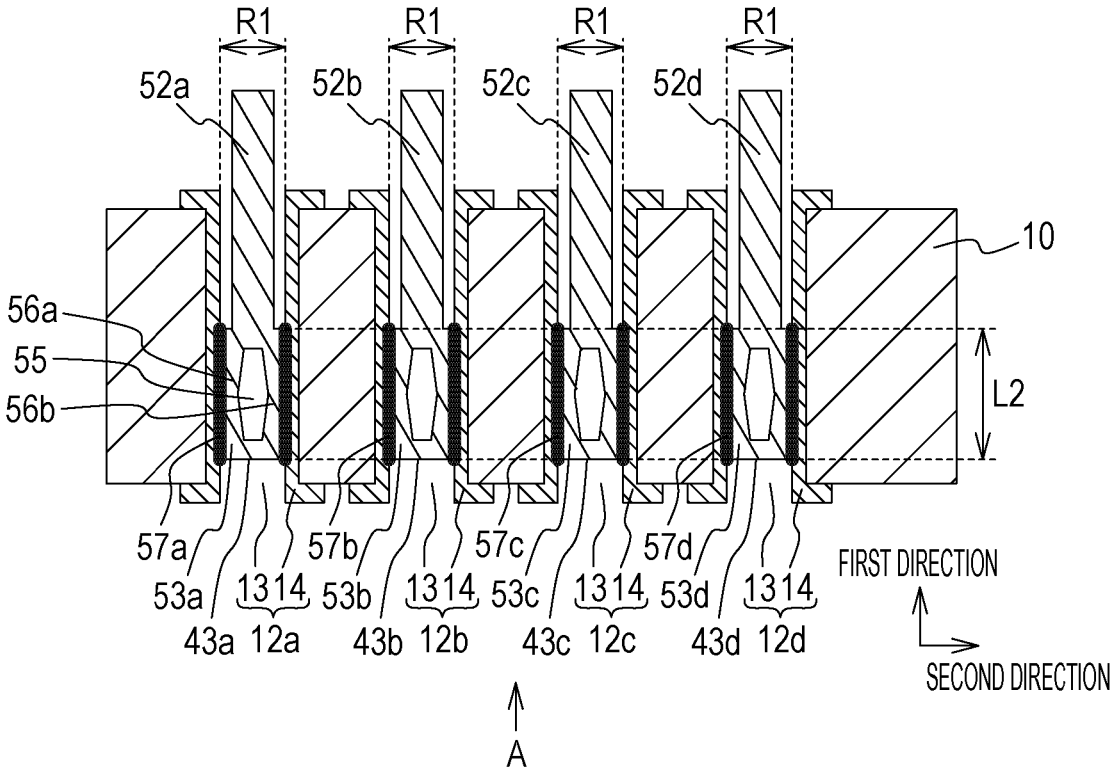
FIG. 5A is an enlarged cross-sectional view of a connecting portion between the connector and a substrate of comparative example 1.
Figure 5B:
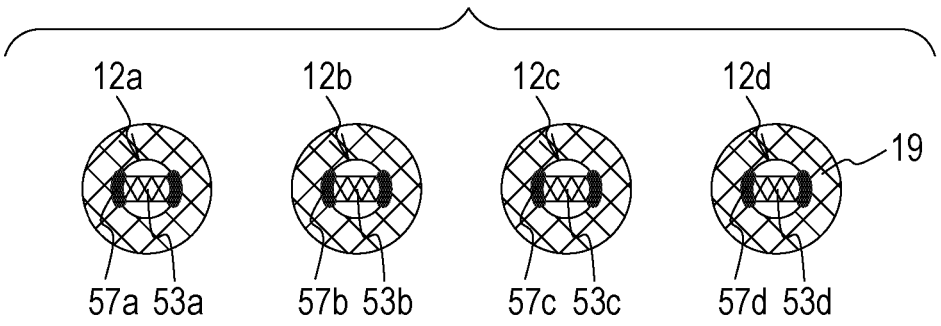
FIG. 5B is a plan view of FIG. 5A as viewed from a direction A.

Here, an electronic device according to comparative example 1 will be described. FIG. 4A is a cross-sectional view of a connector 50 of comparative example 1, and FIG. 4B is a cross-sectional view taken along line A-A of FIG. 4A. FIG. 5A is an enlarged cross-sectional view of a connecting portion between the connector 50 and a substrate 10 of comparative example 1, and FIG. 5B is a plan view of FIG. 5A as viewed from a direction A. As illustrated in FIGS. 4A and 4B, in comparative example 1, all of the cross sectional areas of extending portions 54*a* to 54*d* included in terminals 52*a* to 52*d* of the connector 50 are the same. Here, the cross sectional area of the extending portions 54*a* to 54*d* is defined as S. As illustrated in FIGS. 5A and 5B, in comparative example 1, one ends 43*a* to 43*d* of the terminals 52*a* to 52*d* of the connector 50 are inserted into through holes 12*a* to 12*d* similarly to the first embodiment. At the ends 43*a* to 43*d*, press-in portions 53*a* to 53*d* are provided. Except this point, the structure is the same as that of the first embodiment, so the description is not provided here.

In comparative example 1, the electrical resistances of the extending portions 54*a* to 54*d* included in the terminals 52*a* to 52*d* can be expressed as follows.

Electrical Resistance Ra of Extending Portion 54*a*=ρ·(La1+La2−L1)/S Electrical Resistance Rb of Extending Portion 54*b*=ρ·(Lb1+Lb2−L1)/S Electrical Resistance Rc of Extending Portion 54*c*=p·(Lc1+Lc2−L1)/S Electrical Resistance Rd of Extending Portion 54*d*=ρ·(Ld1+Ld2−L1)/S In the expressions, ρ is conductivities of conductors forming the extending portions 54*a* to 54*d*. All of the extending portions 54*a* to 54*d* are formed from the same material, and thus all the conductivities ρ of the extending portions 54*a* to 54*d* are the same.

As described above, the lengths of the extending portions 54*a* to 54*d* satisfy a relationship, the length of the extending portion 54*a* (La1+La2−L1)>the length of the extending portion 54*b* (Lb1+Lb2−L1)>the length of the extending portion 54*c* (Lc1+Lc2−L1)>the length of the extending portion 54*d* (Ld1+Ld2−L1). Therefore, the electrical resistances of the extending portions 54*a* to 54*d* satisfy a relationship, the electrical resistance Ra of the extending portion 54*a*>the electrical resistance Rb of the extending portion 54*b*>the electrical resistance Rc of the extending portion 54*c*>the electrical resistance Rd of the extending portion 54*d*. Therefore, the electrical resistances of the terminal 52*a*, the terminal 52*b*, the terminal 52*c*, and the terminal 52*d* become smaller in this order. Since the press-in portions 53*a* to 53*d* have the same shape and the same size, the contact resistances (electrical resistances) at the joined portions 57*a* to 57*d* are the same.

As described above, in comparative example 1, the electrical resistances of the terminals 52*a* to 52*d* are different from each other, generating a distribution in the magnitude of current flowing through the terminals 52*a* to 52*d* unfortunately. For example, when the electrical resistance become smaller in the order of the terminal 52*a*, the terminal 52*b*, the terminal 52*c*, and the terminal 52*d*, the current flowing through the terminal 52*a*, the terminal 52*b*, the terminal 52*c*, and the terminal 52*d* become larger in this order, applying higher loads in this order.

On the other hand, in the first embodiment, as illustrated in FIG. 2C, the extending portions 54*a* to 54*d* have cross sectional areas that are different from each other. Thus, in the first embodiment, the electrical resistances of the extending portions 54*a* to 54*d* can be expressed as follows.

Electrical Resistance Ra of Extending Portion 54*a*=ρ·(La1+La2−L1)/Sa Electrical Resistance Rb of Extending Portion 54*b*=ρ·(Lb1+Lb2−L1)/Sb Electrical Resistance Rc of Extending Portion 54*c*=ρ·(Lc1+Lc2−L1)/Sc Electrical Resistance Rd of Extending Portion 54*d*=ρ·(Ld1+Ld2−L1)/Sd As described above, the cross sectional areas of the extending portions 54*a* to 54*d* satisfy a relationship, the cross sectional area Sa of the extending portion 54*a*>the cross sectional area Sb of the extending portion 54*b*>the cross sectional area Sc of the extending portion 54*c*>the cross sectional area Sd of the extending portion 54*d*. Therefore, even when the lengths of the extending portion 54*a*, the extending portion 54*b*, the extending portion 54*c*, and the extending portion 54*d* become shorter in this order, the cross sectional areas become smaller in this order, so that the electrical resistances Ra to Rd of the extending portions 54*a* to 54*d* can be made the same.

According to the first embodiment, as illustrated in FIGS. 2A to 3B, the length (La1+La2) of the terminal 52*a* inserted into and joined to the through hole 12*a* is longer than the length (Lb1+Lb2) of the terminal 52*b* inserted into and joined to the through hole 12*b*. The cross sectional area Sa of the extending portion 54*a* of the terminal 52*a* positioned on the side of the other end 45*a* of the terminal 52*a* with respect to the joined portion 57*a* is larger than the cross sectional area Sb of the extending portion 54*b* of the terminal 52*b* positioned on the side of the other end 45*b* of the terminal 52*b* with respect to the joined portion 57*b*. Thus, as described above, the electrical resistances of the extending portion 54*a* and the extending portion 54*b* can be made the same. In addition, the terminals 52*a* and 52*b* are inserted into and joined to the through holes 12*a* and 12*b* having the same inner diameter R1. For example, when the sizes of the press-in portions 53*a* and 53*b* are made different according to the difference in the cross sectional areas of the extending portions 54*a* and 54*b*, the sizes of the inner diameters of the through holes 12*a* and 12*b* are different from each other, and the contact areas between the press-in portions 53*a* and 53*b* and the through holes 12*a* and 12*b*, respectively, become different from each other. In this case, the contact resistance at the joined portion 57*a* between the terminal 52*a* and the through hole 12*a* and the contact resistance at the joined portion 57*b* between the terminal 52*b* and the through hole 12*b* become different from each other. Therefore, even if the difference in electrical resistance between the extending portion 54*a* and the extending portion 54*b* become small, due to the difference in contact resistances between the terminals 52*a* and 52*b* and the through holes 12*a* and 12*b*, respectively, the magnitudes of the current flowing through the terminal 52*a* and the current flowing through the terminal 52*b* are different. On the other hand, in the first embodiment, the terminals 52*a* and 52*b* are inserted into and joined to the through holes 12*a* and 12*b* having the same inner diameter R1. Thus, the contact areas between the press-in portions 53*a* and 53*b* and the through holes 12*a* and 12*b*, respectively, can be made the same. For example, the contact resistance at the joined portion 57*a* and the contact resistance at the joined portion 57*b* can be made the same. Therefore, the sum of the contact resistance at the joined portion 57*a* and the electrical resistance of the terminal 52*a* from the joined portion 57*a* to the other end 45*a* and the sum of the contact resistance at the joined portion 57*b* and the electrical resistance of the terminal 52*b* from the joined portion 57*b* to the other end 45*b* can be made the same. Therefore, the difference between the magnitudes of the current flowing through the terminal 52*a* and the current flowing through the terminal 52*b* can be reduced.

By making magnitudes of the current flowing from the terminals 52*a* and 52*b* to the through holes 12*a* and 12*b*, respectively, almost the same, the internal wirings 15 of the substrate 10 can be formed without considering the shapes of the terminals 52*a* and 52*b*, reducing the number of design steps.

Further, by making the through holes 12*a* to 12*d* have the same inner diameter R1, the gaps between the electrodes 19 can be the gap D2 of the same magnitude when the gaps between the through holes 12*a* to 12*d* are the gaps D1 of the same magnitude as illustrated in FIG. 3B. For example, if the inner diameters of the through holes 12*a* to 12*d* are different from each other when the gaps between the through holes 12*a* to 12*d* are the gaps D1 of the same magnitude, the gaps between the electrodes 19 become different from each other. In this case, when a wiring pattern is provided on the substrate 10 through a space between the electrodes 19, the width of the wiring pattern may be uneven. When this wiring pattern is coupled to the through holes 12*a* to 12*d*, a distribution in the magnitudes of the current flowing through the terminals 52*a* to 52*d* may be generated due to the influence of the electrical resistance of the wiring pattern. However, by making the through holes 12*a* to 12*d* have the same inner diameter R1 as described in the first embodiment, the gaps D2 between the electrodes 19 are made the same. Thus, the width of the wiring pattern through the space between the electrodes 19 can be made even, and generation of a distribution in the magnitudes of the current flowing through the terminals 52*a* to 52*d* may be suppressed.

As illustrated in FIG. 3A, it is preferable that the length of the joined portion 57*a* in the first direction be the same as the length of the joined portion 57*b* in the first direction. This makes it possible to effectively reduce the difference in electrical resistance (contact resistance) between the terminals 52*a* and 52*b* and the through holes 12*a* and 12*b*, respectively. Further, as illustrated in FIG. 3A, the fitting force of the terminal 52*a* to the through hole 12*a* and the fitting force of the terminal 52*b* to the through hole 12*b* may be made almost the same.

As illustrated in FIG. 1, the terminals 52*a* to 52*d* of the connector 50 are power supply terminals, to which a power supply voltage is applied from the power supply unit 31 and through which current flows. In this case, large current flows through the terminals 52*a* to 52*d*, and thus the effect of making the magnitudes of the current flowing through the terminals 52*a* to 52*d* almost the same is great.

Second Embodiment

Figure 6A:
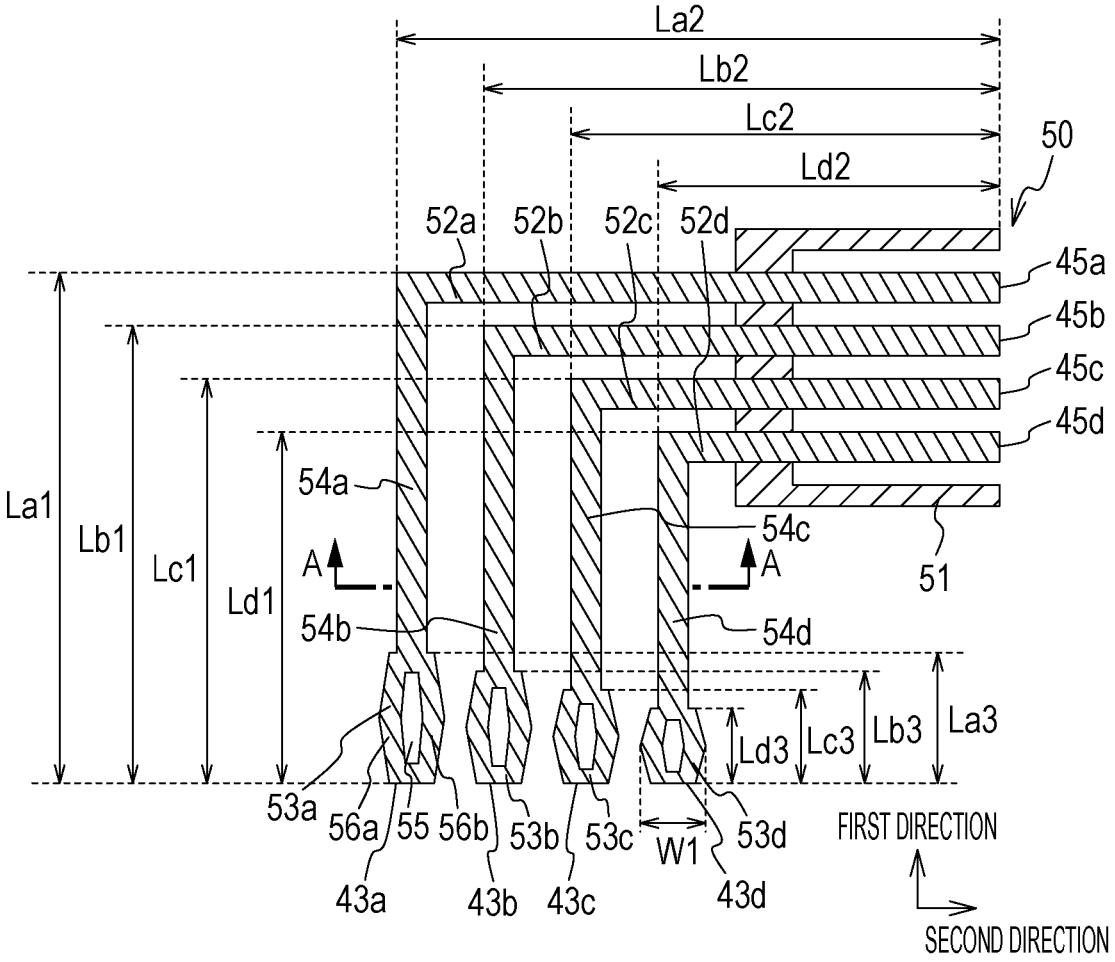
FIG. 6A is a cross-sectional view of a connector in a second embodiment.
Figure 6B:
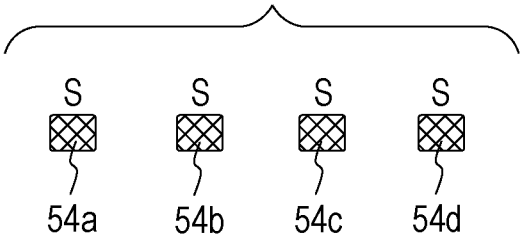
FIG. 6B is a cross-sectional view taken along line A-A of FIG. 6A.

FIG. 6A is a cross-sectional view of a connector 50 of a second embodiment, and FIG. 6B is a cross-sectional view taken along line A-A of FIG. 6A. As illustrated in FIGS. 6A and 6B, in the second embodiment, all of the cross sectional areas of extending portions 54*a* to 54*d* included in terminals 52*a* to 52*d* of the connector 50 are the same. Here, the cross sectional area of the extending portions 54*a* to 54*d* is defined as S. All of the press-in portions 53*a* to 53*d* have different shapes and different sizes. When the lengths of the press-in portions 53*a* to 53*d* in the first direction are defined as lengths La3 to Ld3, a relationship, the length La3 of the press-in portion 53*a*>the length Lb3 of the press-in portion 53*b*>the length Lc3 of the press-in portion 53*c*>the length Ld3 of the press-in portion 53*d*, is satisfied. Similarly to the first embodiment, all of the widths W1 of portions of the press-in portions 53*a* to 53*d* located in the center thereof in the first direction are the same. The widths W1 are from elastic portions 56*a* through open holes 55 to elastic portions 56*b* in the second direction. Except this point, the structure is the same as that of FIGS. 2B and 2C of the first embodiment, so the description is not provided here.

Figure 7A:
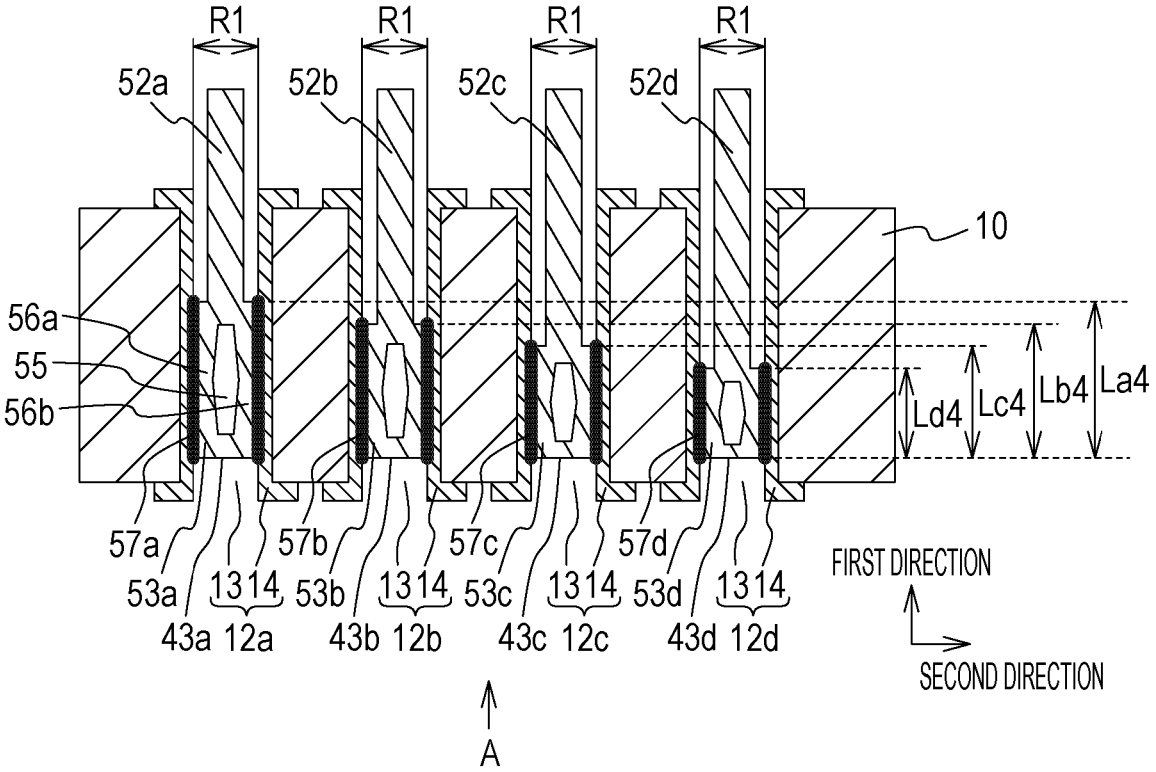
FIG. 7A is an enlarged cross-sectional view of a connecting portion between the connector and a substrate of the second embodiment.
Figure 7B:
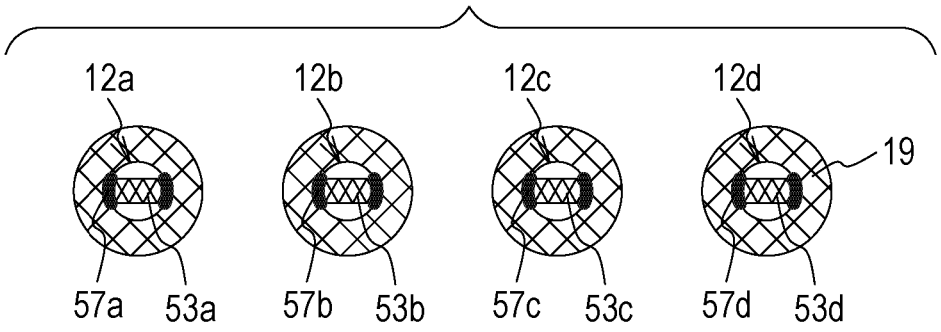
FIG. 7B is a plan view of FIG. 7A as viewed from a direction A.

FIG. 7A is an enlarged cross-sectional view of a connecting portion between the connector 50 and a substrate 10 of the second embodiment, and FIG. 7B is a plan view of FIG. 7A as viewed from a direction A. As illustrated in FIGS. 7A and 7B, in the second embodiment, one ends 43*a* to 43*d* of the terminals 52*a* to 52*d* of the connector 50 are inserted into through holes 12*a* to 12*d* similarly to the first embodiment. At the ends 43*a* to 43*d*, press-in portions 53*a* to 53*d* are provided. Thus, the outer surfaces of the elastic portions 56*a* and 56*b* included in the press-in portions 53*a* to 53*d* are brought into pressure contact with the metal layers 14 exposed on the inner surfaces of the through holes 12*a* to 12*d*, respectively. Thus, the terminals 52*a* to 52*d* are electrically coupled to the through holes 12*a* to 12*d*. Since the lengths of the press-in portions 53*a* to 53*d* in the first direction are different from each other, the lengths of the joined portions 57*a* to 57*d* between the terminals 52*a* to 52*d* and the through holes 12*a* to 12*d*, respectively, in the first direction are different from each other. When the lengths of the joined portions 57*a* to 57*d* in the first direction are defined as lengths La4 to Ld4, a relationship, the length La4 of the joined portion 57*a*>the length Lb4 of the joined portion 57*b*>the length Lc4 of the joined portion 57*c*>the length Ld4 of the joined portion 57*d*, is satisfied. Except this point, the structure is the same as that of FIGS. 3A and 3B of the first embodiment, so the description is not provided here.

In the second embodiment, the electrical resistances of the extending portions 54*a* to 54*d* can be expressed as follows.

Electrical Resistance Ra of Extending Portion 54*a*=ρ·(La1+La2−La3)/S Electrical Resistance Rb of Extending Portion 54*b*=ρ·(Lb1+Lb2−Lb3)/S Electrical Resistance Rc of Extending Portion 54*c*=ρ·(Lc1+Lc2−Lc3)/S Electrical Resistance Rd of Extending Portion 54*d*=ρ·(Ld1+Ld2−Ld3)/S In addition, as described above, the magnitudes of the current flowing through the terminals 52*a* to 52*d* are affected by the contact resistances at the joined portions 57*a* to 57*d*. In the second embodiment, since the lengths of the press-in portions 53*a* to 53*d* in the first direction are different, the lengths of the joined portions 57*a* to 57*d* in the first direction are different, so that the contact resistances are different. Therefore, the contact resistances at the joined portions 57*a* to 57*d* are defined as contact resistances Ra1 to Rd1.

In this case, the electrical resistances acting on the current flowing through the terminals 52*a* to 52*d* can be expressed as follows.

Electrical Resistance R1 of Terminal 52*a*=ρ·(La1+La2−La3)/S+Ra1

Electrical resistance of Terminal 52*b* R2=ρ·(Lb1+Lb2−Lb3)/S+Rb1

Electrical Resistance R3 of Terminal 52*c*=ρ·(Lc1+Lc2−Lc3)/S+Rc1

Electrical Resistance R4 of Terminal 52*d*=ρ·(Ld1+Ld2−Ld3)/S+Rd1

All of the inner diameters R1 of the through holes 12*a* to 12*d* are the same and the lengths of the joined portions 57*a* to 57*d* in the first direction become shorter in the order of the joined portion 57*a*, the joined portion 57*b*, the joined portion 57*c*, and the joined portion 57*d*. Therefore, the contact resistances Ra1 to Rd1 satisfy a relationship, the contact resistance Ra1<the contact resistance Rb1<the contact resistance Rd<the contact resistance Rd1. Therefore, it can be understood that even when the lengths of the terminal 52*a*, the terminal 52*b*, the terminal 52*c*, and the terminal 52*d* become shorter in this order, differences between the electrical resistances R1 to R4 of the terminals 52*a* to 52*d* can be smaller by making the contact resistance Ra1, the contact resistance Rb1, the contact resistance Rc1, and the contact resistance Rd1 become larger in this order.

According to the second embodiment, as illustrated in FIGS. 6A to 7B, the length (La1+La2) of the terminal 52*a* inserted into and joined to the through hole 12*a* is longer than the length (Lb1+Lb2) of the terminal 52*b* inserted into and joined to the through hole 12*b*. The length La4 of the joined portion 57*a* of the terminal 52*a* in the first direction is longer than the length Lb4 of the joined portion 57*b* of the terminal 52*b* in the first direction. Since the terminal 52*a* is longer than the terminal 52*b*, the electrical resistance of the terminal 52*a* tends to be higher. However, by making the joined portion 57*a* of the terminal 52*a* longer than the joined portion 57*b* of the terminal 52*b*, the contact resistance at the joined portion 57*a* can be made smaller than the contact resistance at the joined portion 57*b*. Therefore, the difference between electrical resistances that affect the current flowing through the terminals 52*a* and 52*b* may be reduced. Therefore, the difference between the magnitudes of the current flowing through the terminal 52*a* and the current flowing through the terminal 52*b* may be reduced.

In addition, according to the second embodiment, as illustrated in FIG. 6A, the cross sectional areas of the other ends 45*a* to 45*d* projecting from the front end of the housing 51 of the terminals 52*a* to 52*d* are cross sectional areas S of the same magnitude. Thus, the fitting forces of the fitting of the terminals 52*a* to 52*d* with terminals 62 of a connector 60 may be made almost the same.

It is preferable that the cross sectional area of the extending portion 54*a* of the terminal 52*a* positioned on the side of the other end 45*a* of the terminal 52*a* with respect to the joined portion 57*a* be the same as a cross sectional area of the extending portion 54*b* of the terminal 52*b* positioned on the side of the other end 45*b* of the terminal 52*b* with respect to the joined portion 57*b* as illustrated in FIG. 6B. Thus, by adjusting the lengths of the joined portions 57*a* and 57*b*, it is possible to easily realize current flowing through the terminals 52*a* and 52*b* that are of the same magnitude. Further, since the cross sectional areas of the other ends 45*a* and 45*b* projecting from the front ends of the housing 51 of the terminals 52*a* and 52*b* are the same, the fitting forces of the terminals 52*a* and 52*b* with the terminals 62 of the connector 60 may be made the same.

In the first embodiment described above, the length of the joined portion 57*a* of the terminal 52*a* in the first direction and the length of the joined portion 57*b* of the terminal 52*b* in the first direction may be different similarly to the second embodiment. For example, the length of the joined portion 57*a* of the terminal 52*a* in the first direction may be longer than the length of the joined portion 57*b* of the terminal 52*b* in the first direction. Thus, the electrical resistances that affect the current flowing through the terminals 52*a* and 52*b* may be adjusted using the two parameters of the cross sectional areas of the extending portions 54*a* and 54*b* and the lengths of the joined portions 57*a* and 57*b*. Therefore, the electrical resistances can be adjusted with good precision, and the difference between the magnitudes of the current flowing through the terminals 52*a* and 52*b* may be effectively reduced.

Third Embodiment

Figure 8A:
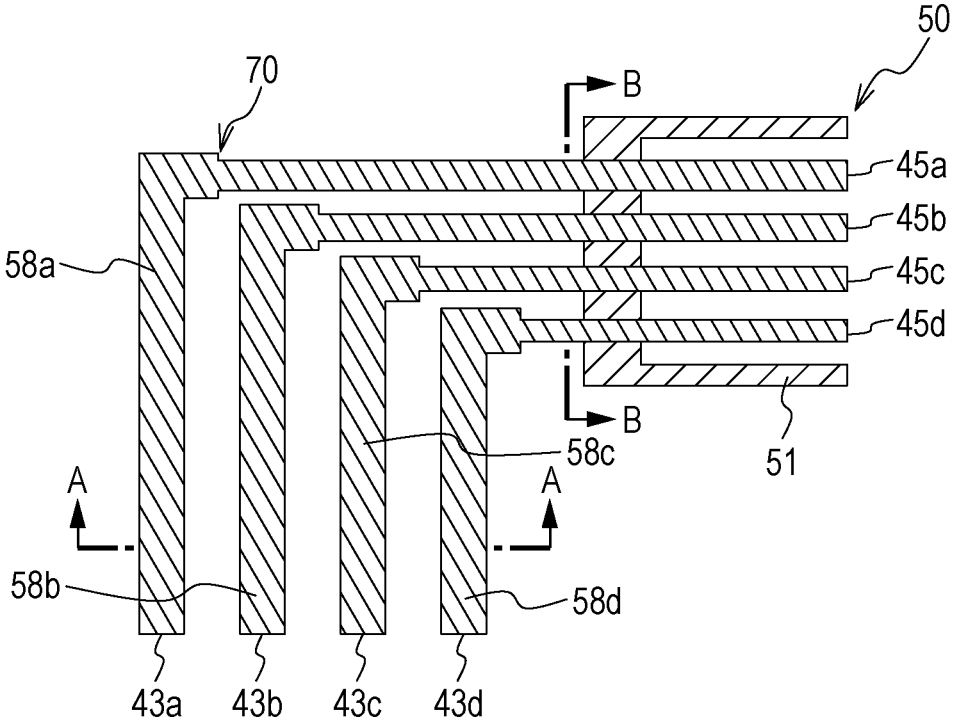
FIG. 8A is a cross-sectional view of a connector according to a third embodiment.
Figure 8B:
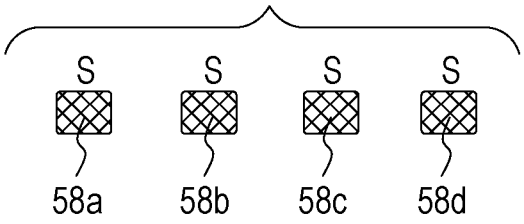
FIG. 8B is a cross-sectional view taken along line A-A of FIG. 8A.
Figure 8C:
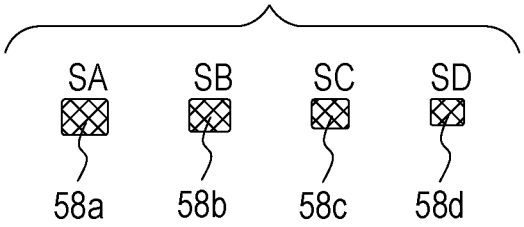
FIG. 8C is a cross-sectional view taken along line B-B of FIG. 8A.

FIG. 8A is a cross-sectional view of a connector 50 according to a third embodiment, FIG. 8B is a cross-sectional view taken along line A-A of FIG. 8A, and FIG. 8C is a cross-sectional view taken along line B-B of FIG. 8A. In the first and second embodiments, cases where the connector 50 is provided with the terminals 52*a* to 52*d* that are press-fit terminals having the press-in portions 53*a* to 53*d* are illustrated and described as examples. In the third embodiment, as illustrated in FIG. 8A, a connector 50 is provided with terminals 58*a* to 58*d* not having press-in portions 53*a* to 53*d*. As illustrated in FIGS. 8A to 8C, the terminals 58*a* to 58*d* extend such that the cross sectional area does not change to be substantially constant on one ends 43*a* to 43*d* to be inserted into through holes 12*a* to 12*d* of a substrate 10. The cross sectional area of the terminals 58*a* to 58*d* at this portions is defined as S. Each of the terminals 58*a* to 58*d* has a stepped portion 70 whose cross sectional area changes between the one ends 43*a* to 43*d* to be inserted into the through holes 12*a* to 12*d* of the substrate 10 and the other ends 45*a* to 45*d* on the opposite side. For example, the terminals 58*a* to 58*d* have a stepped structure. On the side of the other ends 45*a* to 45*d* of the terminals 58*a* to 58*d* with respect to the stepped portions 70, the longer the terminals 58*a* to 58*d* are, the larger the cross sectional areas are. For example, a relationship, the cross sectional area SA of the terminal 58*a*>the cross sectional area SB of the terminal 58*b*>the cross sectional area SC of the terminal 58*c*>the cross sectional area SD of the terminal 58*d*, is satisfied.

Figure 9:
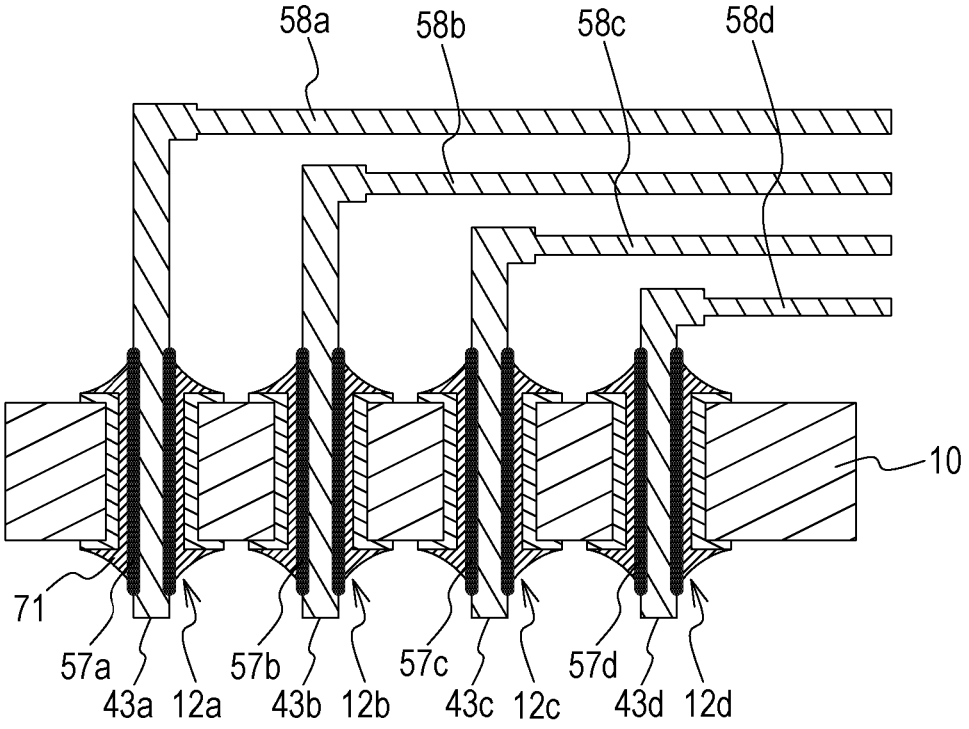
FIG. 9 is an enlarged cross-sectional view of a connecting portion between the connector and a substrate of the third embodiment.

FIG. 9 is an enlarged cross-sectional view of a connecting portion between the connector 50 and the substrate 10 of the third embodiment. As illustrated in FIG. 9, in the third embodiment, the terminals 58*a* to 58*d* of the connector 50 are joined to the through holes 12*a* to 12*d* of the substrate 10 by solder 71. In this case, the joined portions 57*a* to 57*d* joined to the through holes 12*a* to 12*d* of the terminals 58*a* to 58*d* are portions of the terminals 58*a* to 58*d* that are in contact with the solder 71. In FIG. 9, the joined portions 57*a* to 57*d* are represented by bold lines.

According to the third embodiment, as illustrated in FIGS. 8A to 8C, the cross sectional area SA on the side of the other end 45*a* of the terminal 58*a* is larger than the cross sectional area SB on the side of the other end 45*b* of the terminal 58*b*. Thus, even when the terminal 58*a* is longer than the terminal 58*b*, the difference in electrical resistance between the terminal 58*a* and the terminal 58*b* may be reduced. In addition, as illustrated in FIG. 9, the terminals 58*a* and 58*b* are inserted into and joined to the through holes 12*a* and 12*b* having the same inner diameter. Thus, the difference between the contact resistances of the joined portions 57*a* and 57*b* may be reduced. Therefore, the difference between the magnitudes of the current flowing through the terminal 58*a* and the current flowing through the terminal 58*b* may be reduced. Thus, even when the terminals 58*a* to 58*d* of the connector 50 are joined to the through holes 12*a* to 12*d* of the substrate 10 by the solder 71, it is possible to cause current of almost the same magnitude to flow through the terminals 58*a* to 58*d*.

Fourth Embodiment

Figure 10A:
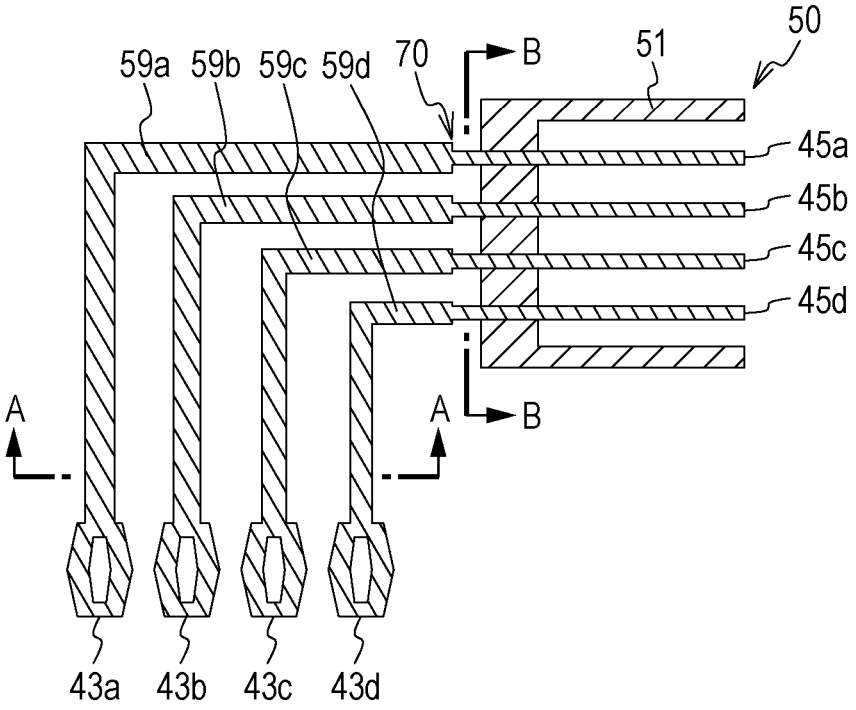
FIG. 10A is a cross-sectional view of a connector of a fourth embodiment.
Figure 10B:
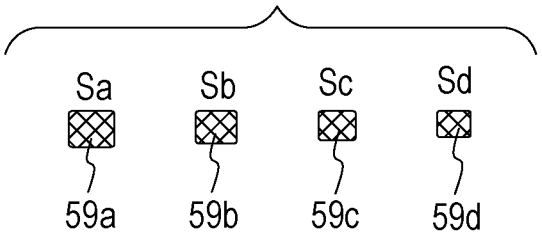
FIG. 10B is a cross-sectional view taken along line A-A of FIG. 10A.
Figure 10C:
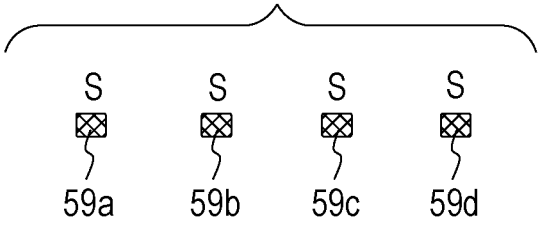
FIG. 10C is a cross-sectional view taken along line B-B of FIG. 10A.

FIG. 10A is a cross-sectional view of a connector 50 according to a fourth embodiment, FIG. 10B is a cross-sectional view taken along line A-A of FIG. 10A, and FIG. 10C is a cross-sectional view taken along line B-B of FIG. 10A. As illustrated in FIG. 10A to FIG. 10C, according to the fourth embodiment, each of terminals 59*a* to 59*d* is provided with a stepped portion 70. The cross sectional areas of the terminals 59*a* to 59*d* on the side of the one ends 43*a* to 43*d* with respect to the stepped portions 70 are defined as cross sectional areas Sa to Sd similarly to the terminals 52*a* to 52*d* of the first embodiment. The one ends 43*a* to 43*d* are inserted into through holes formed in a substrate 10. For example, a relationship, the cross sectional area Sa of the terminal 59*a*>the cross sectional area Sb of the terminal 59*b*>the cross sectional area Sc of the terminal 59*c*>the cross sectional area SD of the terminal 58*d*, is satisfied. On the other hand, the cross sectional areas of the terminals 59*a* to 59*d* on the side of the other ends 45*a* to 45*d* with respect to the stepped portion 70 are sectional areas S of the same magnitude. Except this point, the structure is the same as that of FIGS. 2B and 2C of the first embodiment, so the description is not provided here.

According to the fourth embodiment, the cross sectional areas of the other ends 45*a* to 45*d* exposing from the front end of a housing 51 of the terminals 59*a* to 59*d* are cross sectional areas S of the same magnitude. Thus, the fitting forces of the fitting of the terminals 59*a* to 59*d* with terminals 62 of a connector 60 may be made almost the same. In addition, since the lengths of the joined portions of the terminals 59*a* to 59*d* in the first direction are the same, the fitting force of the terminals 59*a* to 59*d* to the through holes 12*a* to 12*d* may be the same.

In the first to fourth embodiments, cases where a connector is provided as an electronic component with terminals inserted into and joined to through holes of a substrate are illustrated and described, but other electronic components may be used. For example, a semiconductor component having a semiconductor element may be used.

Although the embodiments of the present invention have been described in detail above, the present invention is not limited to such specific embodiments, and various modifications and alternations may be made within the scope of the gist of the present invention described in the claims.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An electronic component comprising:

a first terminal that is inserted and joined to a first through hole formed in a substrate; and a second terminal that is inserted into and joined to a second through hole having an inner diameter that is the same as an inner diameter of the first through hole and formed in the substrate, wherein a length of the first terminal from a first end that is inserted into the first through hole to a second end that is opposite to the first end is longer than a length of the second terminal from a third end that is inserted into the second through hole to a fourth end that is opposite to the third end, and a cross-sectional area of a portion of the first terminal positioned on a side of the second end with respect to a first joined portion at which the first terminal is joined to the first through hole is larger than a cross sectional area of a portion of the second terminal positioned on a side of the fourth end with respect to a second joined portion at which the second terminal is joined to the second through hole;

wherein the first terminal and the second terminal are power supply terminals to which current is supplied from a power supply circuit.

2. The electronic component according to claim 1, wherein a length of the first joined portion in a direction in which the first terminal is inserted into the first through hole and a length of the second joined portion in a direction in which the second terminal is inserted into the second through hole are the same.

3. The electronic component according to claim 1, wherein a length of the first joined portion in a direction in which the first terminal is inserted into the first through hole and a length of the second joined portion in a direction in which the second terminal is inserted into the second through hole are different.

4. The electronic component according to claim 3, wherein the length of the first joined portion in the direction in which the first terminal is inserted into the first through hole is larger than the length of the second joined portion in the direction in which the second terminal is inserted into the second through hole.

5. The electronic component according to claim 1, wherein a cross sectional area at the second end of the first terminal and a cross sectional area at the fourth end of the second terminal are the same.

6. The electronic component according to claim 1, wherein in a case where the first terminal and the second terminal are press-fit terminals, the first joined portion is a portion where the first terminal is in contact with the first through hole and the second joined portion is a portion where the second terminal is in contact with the second through hole, and in a case where the first terminal and the second terminal are joined to the first through hole and the second through hole through solder respectively, the first joined portion is a portion of the first terminal that is in contact with the solder and the second joined portion is a portion of the second terminal that is in contact with the solder.

7. The electronic component according to claim 1, wherein a sum of a contact resistance at the first joined portion of the first terminal and an electrical resistance of the first terminal from the first joined portion to the second end of the first terminal and a sum of a contact resistance at the second joined portion and an electrical resistance of the second terminal from the second joined portion to the fourth end of the second terminal is the same.

8. The electronic component according to claim 1, wherein in the first terminal, a width of the first joined portion is larger than a width of a portion of the first terminal on a side of the second end with respect to the first joined portion, and in the second terminal, a width of the second joined portion is larger than a width of a portion of the second terminal on a side of the fourth end with respect to the second joined portion.

9. The electronic component according to claim 1, wherein the electronic component is a connector.

10. A substrate formed with a first through hole and a second through hole having the same inner diameter as an inner diameter of the first through hole, the substrate comprising an electronic component including a first terminal inserted into and joined to the first through hole and a second terminal inserted into and joined to the second through hole, wherein in the electronic component, a length of the first terminal from a first end that is inserted into the first through hole to a second end that is opposite to the first end is longer than a length of the second terminal from a first end that is inserted into the second through hole to a second end that is opposite to the first end, and one of a first condition in which a cross sectional area of a portion of the first terminal positioned on a side of the second end with respect to a first joined portion at which the first terminal is joined to the first through hole is larger than a cross sectional area of a portion of the second terminal positioned on a side of the second end with respect to a second joined portion at which the second terminal is joined to the second through hole and a second condition in which a length of a first joined portion of the first terminal at which the first terminal is joined to the first through hole in a direction in which the first terminal is inserted into the first through hole is longer than a length of a second joined portion of the second terminal at which the second terminal is joined to the second through hole in a direction in which the second terminal is inserted into the second through hole is satisfied;

wherein the first terminal and the second terminal are power supply terminals to which current is supplied from a power supply circuit.

* * * * *